United States Patent [19]

Igel

[11] Patent Number: 4,570,431

[45] Date of Patent: Feb. 18, 1986

[54] DEVICE FOR GRIPPING AND HOLDING A TUBE

[75] Inventor: Wolfgang Igel, Ebersbach, Fed. Rep. of Germany

[73] Assignee: Zinser Textilmaschinen GmbH, Ebersbach, Fed. Rep. of Germany

[21] Appl. No.: 582,084

[22] Filed: Feb. 21, 1984

[30] Foreign Application Priority Data

Feb. 22, 1983 [DE] Fed. Rep. of Germany ..... 3305991

[51] Int. Cl.[4] ..... D01H 9/00; B65G 49/00

[52] U.S. Cl. ..... 57/275; 198/803.3; 294/68.1

[58] Field of Search ..... 57/275, 266, 267, 268, 57/269, 270, 271, 272, 273, 274; 242/35.5 A; 294/86 R; 198/653, 655, 656

[56] References Cited

U.S. PATENT DOCUMENTS

| | | | |
|---|---|---|---|
| 3,178,217 | 4/1965 | Bargel | 294/86 R |
| 3,344,593 | 10/1967 | Morikawa et al. | 57/268 X |
| 3,442,072 | 5/1969 | Gillono et al. | 57/275 X |
| 3,765,160 | 10/1973 | Bethea et al. | 57/268 |
| 3,967,847 | 7/1976 | Ellis | 198/653 X |
| 4,036,353 | 7/1977 | Suter | 242/35.5 A X |
| 4,081,949 | 4/1978 | Keller et al. | 57/268 |
| 4,165,585 | 8/1979 | Ishida et al. | 57/275 X |

FOREIGN PATENT DOCUMENTS

| | | | |
|---|---|---|---|
| 1180285 | 10/1964 | Fed. Rep. of Germany | 57/275 |
| 1560417 | 10/1970 | Fed. Rep. of Germany . | |
| 1510593 | 11/1975 | Fed. Rep. of Germany . | |

*Primary Examiner*—Stuart S. Levy
*Assistant Examiner*—Joseph J. Hail, III
*Attorney, Agent, or Firm*—Karl F. Ross; Herbert Dubno

[57] ABSTRACT

A gripper device for retaining and holding the tube of a roving bobbin comprises a pair of juxtaposed gripper elements and a piston-and-cylinder unit for moving them toward and away from one another. The gripper elements are each provided with a cylindrical portion engaging the end of the tube carrying the roving package and a frustoconical segmental apron adapted to rest against the frustoconical end of the roving layer carried by the tube.

4 Claims, 9 Drawing Figures

DEVICE FOR GRIPPING AND HOLDING A TUBE

FIELD OF THE INVENTION

My present invention relates to a device for gripping and holding a tube and, more particularly, to a device for gripping and holding a tube for use in textile applications, i.e. adapted to receive or carrying a textile strand, e.g. a yarn, bundle of threads, roving or the like.

Most specifically, the invention relates to a device for gripping and holding a tube which can have previously been provided with a roving generally in the form of a roving package having frustoconical end portions and forming a roving spool or bobbin.

BACKGROUND OF THE INVENTION

It is known to provide tongs-type gripping and holding devices for a bobbin or package for textile purposes, e.g. for roving spools or bobbins and which are capable of engaging and holding the comparatively heavy roving spools or packages. For example, in German Patent No. 1,510,593, the device is capable of gripping both ends of the tube by means of tongs. The term "tongs" as used herein is intended to refer to a device in which two jaws or engaging elements can be moved toward and away from one another to grip the tube between them.

It is also known to engage a cop on the body of the body of the yarn package or at the upwardly and downwardly projecting ends of the tube by means of tongs, inflatable bellows or other elements. The engagement of the turns of the roving or yarn can serve to damage the textile material and/or alter the form of the package in a detrimental manner. Furthermore, the engagement of the end of the tube at a considerable distance from the center of gravity of the package can result in damage to the core tube carrying the package.

For cops, moreover, devices of this type have been provided which engage the cop at the beveled end thereof in gripper segments of which, for example, three can be provided (see German Patent Document - Open Application DE-OS No. 1,560,417). This engagement of the beveled portion of the winding layer or yarn layer does not, however, ensure a secure and reliable retention of the spool.

OBJECTS OF THE INVENTION

It is the principal object of the present invention to provide an improved device for the engagement and retention of a textile package comprising a layer of textile material on a core tube whereby the disadvantages outlined above are obviated.

Another object of the invention is to provide a device for the purposes described which can more reliably engage a roving spool or bobbin on only one side of the roving layer thereon.

SUMMARY OF THE INVENTION

These objects and others which will become apparent hereinafter are attained, in accordance with the present invention, by providing a gripping and retaining device comprising a pair of opposing gripper elements which can be moved toward and away from one another by any conventional means or means especially provided for this purpose as described below and wherein each of the gripper elements comprises a cylindrical portion engageable with the end region of a roving tube (i.e. a tube on which a roving package or layer is wound) and a further portion in the form of a frustoconical segment which engages and rests against the frustoconically shaped end region of the bobbin.

The system of the invention thus provides a double holding effect. By the clamping of the tube in the cylindrical regions of the grippers, a secure engagement of the spool or package is ensured. By the frustoconical segmental aprons which rest against the frustoconical end of the roving package, tilting forces are precluded, thereby preventing damage to the engaged end of the tube even for heavy roving packages, without endangering the shape or form of the yarn layer or the textile material of which the winding layers are constituted.

According to a feature of the invention, the two gripper elements can be juxtaposed with one another, i.e. diametrically opposite, and can be actuated simultaneously by a common piston-and-cylinder unit.

According to yet another feature of the invention, each of the gripper elements can be mounted upon a lever arm and the lever arms can be connected by a pin so that the piston-and-cylinder unit can be linked and articulated to the two lever arms for the simultaneous actuation of the gripper elements. This ensures in a simple manner a symmetrical actuation of the two gripper elements.

According to still another feature of the invention, the cylindrical portion of the gripper elements can conform to the configuration of the end of the tube engaged thereby, i.e. can be complementary to the tube end.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
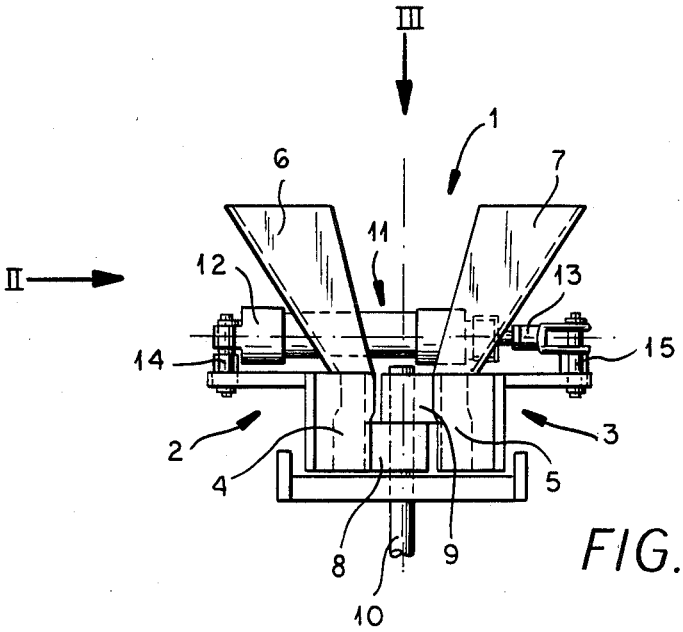
FIG. 1 is a side-elevational view of a gripper device of the present invention.
Figure 2:
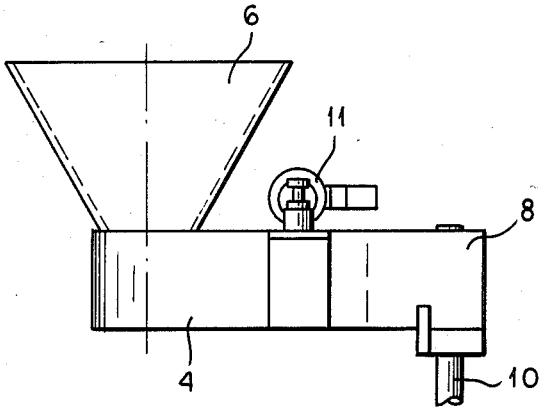
FIG. 2 is an elevational view in the direction of the arrow II of FIG. 1.
Figure 3:
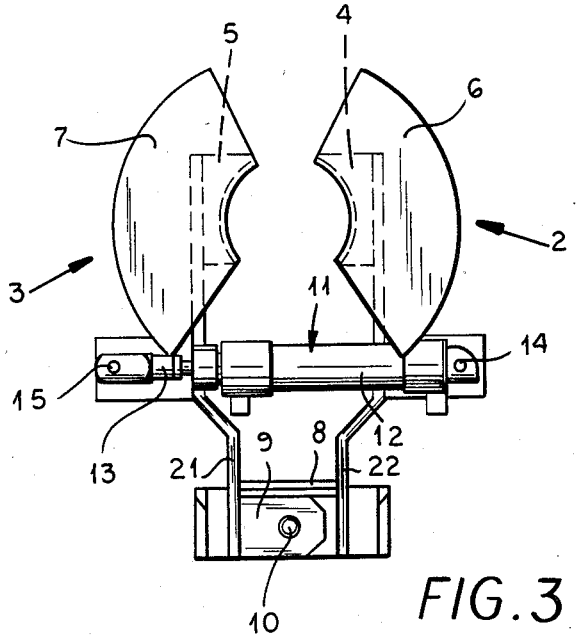
FIG. 3 is a view of the device in the direction of arrow III showing the unit in its closed position.
Figure 4:
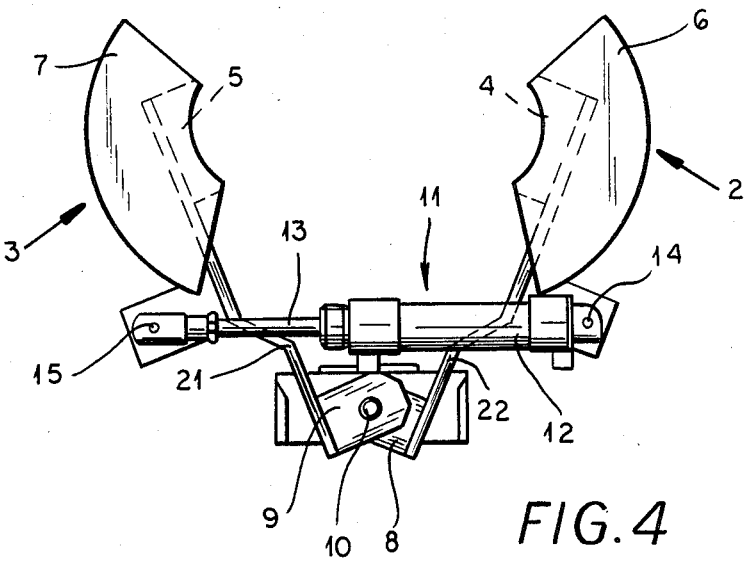
FIG. 4 is a view similar to FIG. 3 illustrating the gripper elements in their open position.
Figure 5:
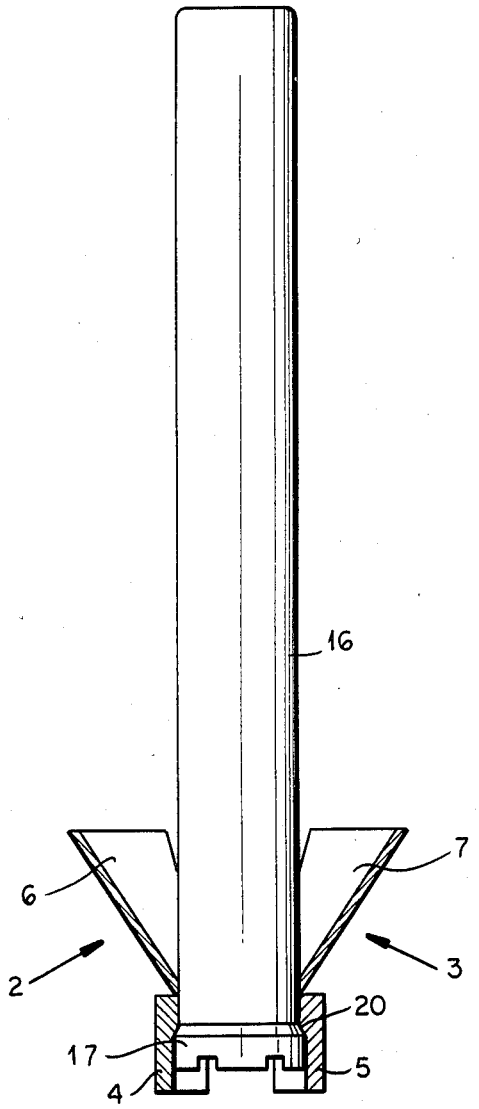
FIG. 5 is an elevational view illustrating the retention of a tube utilizing the device of the invention with parts thereof broken away or shown in cross section.
Figure 6:
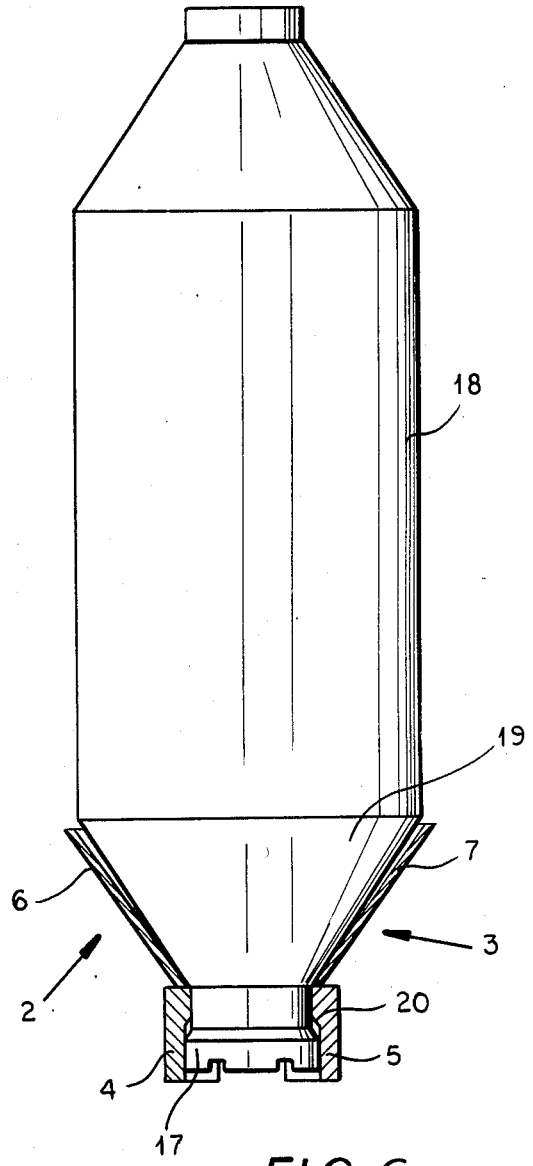
FIG. 6 is a view similar to FIG. 5 illustrating the retention and engagement of a roving bobbin according to the invention.

FIGS. 1–4 show a device 1 for gripping and retaining a tube or a roving package or bobbin provided with a tube as a core on which the roving, constituting the textile material, is wound in a layer having a frustoconical end portion adjacent the tube end to be engaged in the gripper device (compare FIGS. 5 and 6).

The device basically comprises two diametrically opposite gripper elements 2 and 3 and each of these gripper elements is formed with a cylindrical portion 4 or 5 and a frustoconical segment or apron 6 or 7 secured thereto.

As can be seen from FIGS. 3 and 4, the cylindrical portions 4 and 5 of the gripper elements are respectively mounted on levers 21 and 22 which are extended into lever arms 8 and 9, respectively.

These lever arms 8 and 9 are pivotally interconnected by a common pin 10 forming a fulcrum for both levers. The gripper elements 2 and 3 can thus be swung about the axis of this common pin.

To swing the gripper elements toward and away from one another (compare FIGS. 3 and 4), each lever 21 or 22 is connected by a link or articulation 14 or 15 pivotally with a piston-and-cylinder unit 11. In this case, the cylinder 12 is pivotally connected at 14 to the lever 22 while the piston rod 13 is pivotally connected at 15 with the lever 21 of the gripper element 3.

When the piston-and-cylinder unit 11 is hydraulically or pneumatically actuated, therefore, the piston rod 13 extends from the cylinder 12 and swings the grippers apart, thereby opening the gripper unit as shown in FIG. 4.

Because the cylindrical portions 4 and 5 can be complementarily shaped to engage the whorl end of the tube, they provide a secure engagement of the tube (FIG. 5). In FIG. 5, the cylindrical portions 4 and 5 are shown to grip the end region 17 of an empty tube. The gripper device can thus be used to draw an empty tube onto a textile machine or to remove the empty tube therefrom.

As can be seen from FIG. 6, moreover, because of the frustoconically segmental aprons 6 and 7, the device can also be used effectively to engage a loaded tube.

In FIG. 6 the gripper elements 2 and 3 are shown to engage a bobbin with the frustoconical segments 6 and 7 engaging the frustoconical portion 19 of the roving package or winding 18 carried on the bobbin to precluded tilting forces which might result from the fact that the center of gravity of the package is located close to the center of the yarn layer.

By the combined effect of the cylindrical portions 4 and 5 and the frustoconical segmental portions 6 and 7, comparatively heavy yarn bobbins can be drawn onto or removed from textile machines utilizing the device of the invention.

To facilitate this action, the cylindrical portions 4 and 5 can each have a setback 20 which is complimentary to the end 17 of the tube 16 and which facilitates the mounting and withdrawal of the bobbin at the textile machine.

Because the frustonical end portions of the winding layer of a roving bobbin may have different bevel angles, for effective engagement of the apron 6 and 7 with the end of a particular roving package it may be necessary to replace these aprons with aprons of the appropriate angle or conicity.

Figure 7:
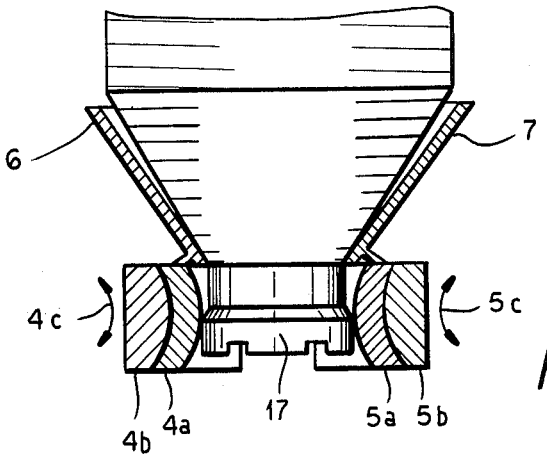
FIGS. 7–9 are views showing various embodiments of the device of the invention in cross section to enable relative movement of the aprons and the bobbin or tube so that replacement of the aprons when the frustoconical ends of the yarn packages have different bevel or taper angles is not necessary.
Figure 8:
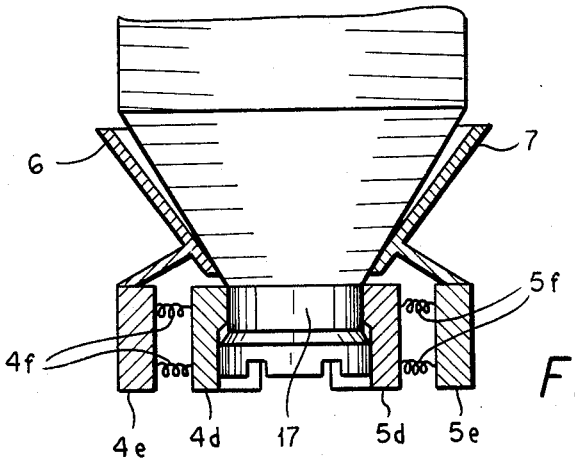
Figure 9:
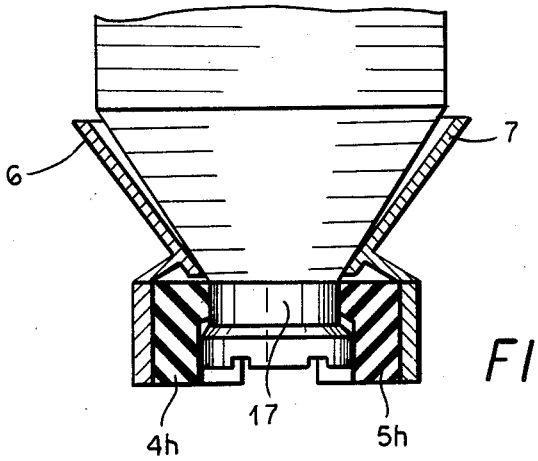

To avoid the need for such replacement, I may use any of the expedients illustrated in FIGS. 7–9 in highly diagrammatic form or a combination thereof to enable some play with respect to the tube-clamping portions 4 and 5 of the gripper elements so that they may cant somewhat as represented by the arrows 4*c* and 5*c* in FIG. 7 to allow the respective aprons 6 and 7 to accommodate themselves to the actual bevel angle of the frustoconical end of the yarn package.

For example, the tube-clamping regions 4 and 5 may have a spherical configuration as shown at 4*a* and 5*a* with these spherically curved portions being able to glide in respective holders 4*b* and 5*b* which can be mounted upon the respective levers.

Alternatively, the gripper elements can be elastically deflectable. For example, they may be composed of elastic material as shown at 4*h* and 5*h* in FIG. 9, or may be elastically supported as shown for the gripper portions 4*d* and 5*d* in FIG. 8.

These gripper portions are mounted by springs 4*f* and 5*f* on supports 4*e* and 5*e* carried by the levers in the manner described previously.

The gripper elements are thus swung by the weight of the bobbin to the extent necessary that the aprons 6 and 7 will lie properly against the frustoconical portion of the package.

I claim:

1. In a textile machine, a device for gripping and retaining a tube, especially a roving package tube having a winding layer formed with a frustoconical end and from which an extremity of said tube projects, said tube having an axis, said device comprising:

a pair of opposing gripper elements each having a cylindrical portion engageable with said extremity of said tube and a frustoconical segmental portion adapted to rest against said end of said layer;

respective layer arms carrying said gripper elements at corresponding ends of said lever arms whereby said frustoconical segmental portions project generally transversely to said lever arms, the cylindrical and frustoconical segmental portions of said gripper elements being substantially centered on said axis when said cylindrical portions engage said extremity of said tube;

means defining an articulation between opposite ends of said arms from those carrying said gripper elements whereby said lever arms are coupled by a common pivot and swingable about said pivot, said pivot having an axis parallel to the first-mentioned axis; and a piston-and-cylinder unit having a cylinder pivotally connected to one of said arms between its said ends and a piston pivotally connected to the other of said arms between its ends, said piston-and-cylinder units extending generally transversely to said arms between said gripper elements and said pivots.

2. The device defined in claim 1 wherein said cylindrical portions are formed internally with configurations complimentary to the configuration of said extremity.

3. The device defined in claim 1 wherein each of said elements is deflectable to permit adjustment of the respective frustoconical segmental portion to an inclination of said end of said layer.

4. The device defined in claim 3 wherein each of said gripper elements has a spherical configuration to enable a swiveling thereof relative to the respective arm.

* * * * *